US010471747B2

(12) United States Patent
Kanamura et al.

(10) Patent No.: US 10,471,747 B2
(45) **Date of Patent: *Nov. 12, 2019**

(54) TAPE CASSETTE AND PRINTER

(71) Applicant: CASIO COMPUTER CO., LTD., Shibuya-ku, Tokyo (JP)

(72) Inventors: Toshiaki Kanamura, Ome (JP); Satomi Midorogi, Iruma (JP); Naoki Ogawa, Tachikawa (JP); Yasushi Murai, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/020,760

(22) Filed: Jun. 27, 2018

(65) Prior Publication Data

US 2019/0009585 A1 Jan. 10, 2019

(30) Foreign Application Priority Data

Jul. 4, 2017 (JP) ..... 2017-131320

(51) Int. Cl.
*B41J 15/04* (2006.01)

(52) U.S. Cl.
CPC ..... *B41J 15/044* (2013.01)

(58) Field of Classification Search
CPC ..... B41J 3/4075; B41J 15/044
See application file for complete search history.

(56) References Cited

U.S. PATENT DOCUMENTS 5,441,586 A * 8/1995 Fukunaga ..... B65C 7/00 156/387
7,296,941 B2 * 11/2007 Suzuki ..... B41J 3/4075 400/578
7,296,947 B2 11/2007 Schmieder et al.
7,866,561 B2 * 1/2011 Tanaka ..... B65C 11/0289 235/492
8,152,392 B2 * 4/2012 Tanaka ..... G06K 19/07749 400/613

(Continued)

FOREIGN PATENT DOCUMENTS

JP 2014028448 A 2/2014

OTHER PUBLICATIONS

Related U.S. Appl. No. 16/020,634, filed Jun. 27, 2018, Title: "Tape Cassette and Printer;" First Named Inventor: Toshiaki Kanamura.

(Continued)

*Primary Examiner* — Huan H Tran
(74) *Attorney, Agent, or Firm* — Holtz, Holtz & Volek PC

(57) ABSTRACT

A tape cassette stores a first medium having: a first base having a print surface for printing and first adhesive applied on an opposite side of the print surface; and a first separator removably attached to the first base via the first adhesive; and a second medium having: a second base; and a second separator removably attached to the second base. The tape cassette includes a pressing member that is movable in a direction intersecting with a direction of a plane of the print surface, and the pressing member is disposed at a position of, when a pressing force is externally applied to perform bonding of the first medium and the second medium mutually, receiving the pressing force.

11 Claims, 10 Drawing Sheets

(56) References Cited

U.S. PATENT DOCUMENTS

| | | | | |
|---|---|---|---|---|
| 2019/0009582 | A1* | 1/2019 | Kanamura | B41J 11/703 |
| 2019/0009584 | A1* | 1/2019 | Kanamura | B41J 2/315 |

OTHER PUBLICATIONS

Related U.S. Appl. No. 16/020,735, filed Jun. 27, 2018, Title: "Tape Cassette and Printer;" First Named Inventor: Toshiaki Kanamura. Office Action (Non-Final Rejection) dated May 13, 2019 issued in related U.S. Appl. No. 16/020,735.

* cited by examiner

TAPE CASSETTE AND PRINTER

CROSS-REFERENCE TO RELATED APPLICATIONS

This application is based upon and claims the benefit of priority under 35 USC 119 of Japanese Patent Application No. 2017-131320 filed on Jul. 4, 2017 the entire disclosure of which, including the description, claims, drawings, and abstract, is incorporated herein by reference in its entirety.

BACKGROUND OF THE INVENTION

1. Field of the Invention

The present disclosure relates to a tape cassette and a printer.

2. Description of the Related Art

Conventionally label printers to print letters, graphics and the like on a long tape to create labels have been known (see Patent Document JP 2014-028448, for example). Some of the labels created by such a label printer include a base having adhesive applied as well as a liner sheet as a separator on the rear face. By peeling off the liner sheet from the base, the adhesive is exposed. A user can attach a label of this type easily to various things due to the adherence of the exposed adhesive.

A sticker that can be attached to human skin also has been known. This sticker includes a liner sheet on each of the rear face and on the surface. In use, a user peels off the liner sheet on the rear face and attaches the sticker on the attachment surface (e.g., skin), and then peels off the liner sheet on the surface.

Such a sticker has a certain pattern printed beforehand, and a user therefore cannot print desired letters and graphics on such a sticker.

One aspect of the present invention aims to provide a technique of supporting the creation of a label enabling printing of desired letters and graphics thereon, and including a liner tape on each of the rear face and the surface.

SUMMARY OF THE INVENTION

According to an embodiment of the present invention, a tape cassette to store a first medium having: a first base having a print surface for printing and first adhesive applied on an opposite side of the print surface; and a first separator removably attached to the first base via the first adhesive; and a second medium having: a second base; and a second separator removably attached to the second base. The tape cassette includes a pressing member that is movable in a direction intersecting with a direction of a plane of the print surface, and the pressing member is disposed at a position of, when a pressing force is externally applied to perform bonding of the first medium and the second medium mutually, receiving the pressing force.

According to an embodiment of the present invention, a printer includes: a cassette container to house a tape cassette configured to store a first base having a print surface for printing and first adhesive applied on an opposite side of the print surface; and a first separator removably attached to the first base via the first adhesive; and a second medium having a second base and a second separator removably attached to the second base, the tape cassette including a pressing member that is movable in a direction intersecting with a direction of a plane of the print surface, and the pressing member being disposed at a position of, when a pressing force is externally applied to bond the first medium and the second medium mutually, receiving the pressing force; a feed roller configured to feed the first medium discharged from the tape cassette; a print head configured to print on the print surface of the first base of the first medium; and a lifting unit configured to move the feed roller up and down, and when the feed roller is brought closer to the print head, the lifting unit applies the pressing force to the first medium while feeding the first medium with the feed roller so that the second base is bonded to the print surface of the first base.

DETAILED DESCRIPTION OF THE INVENTION

Figure 1:
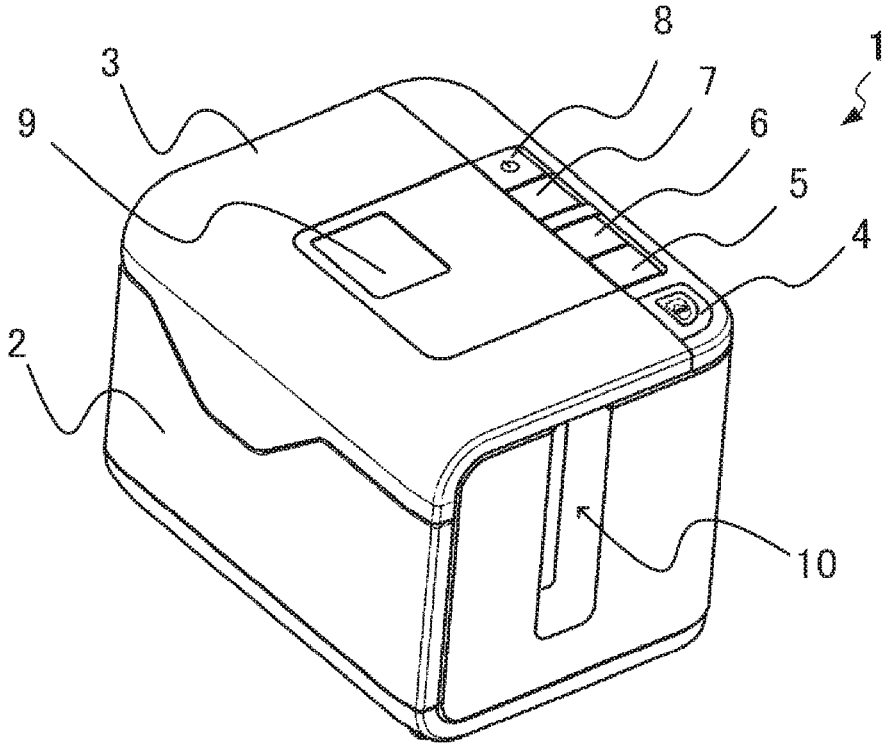
FIG. 1 is a perspective view of a printer 1 when a lid 3 is closed.
Figure 2:
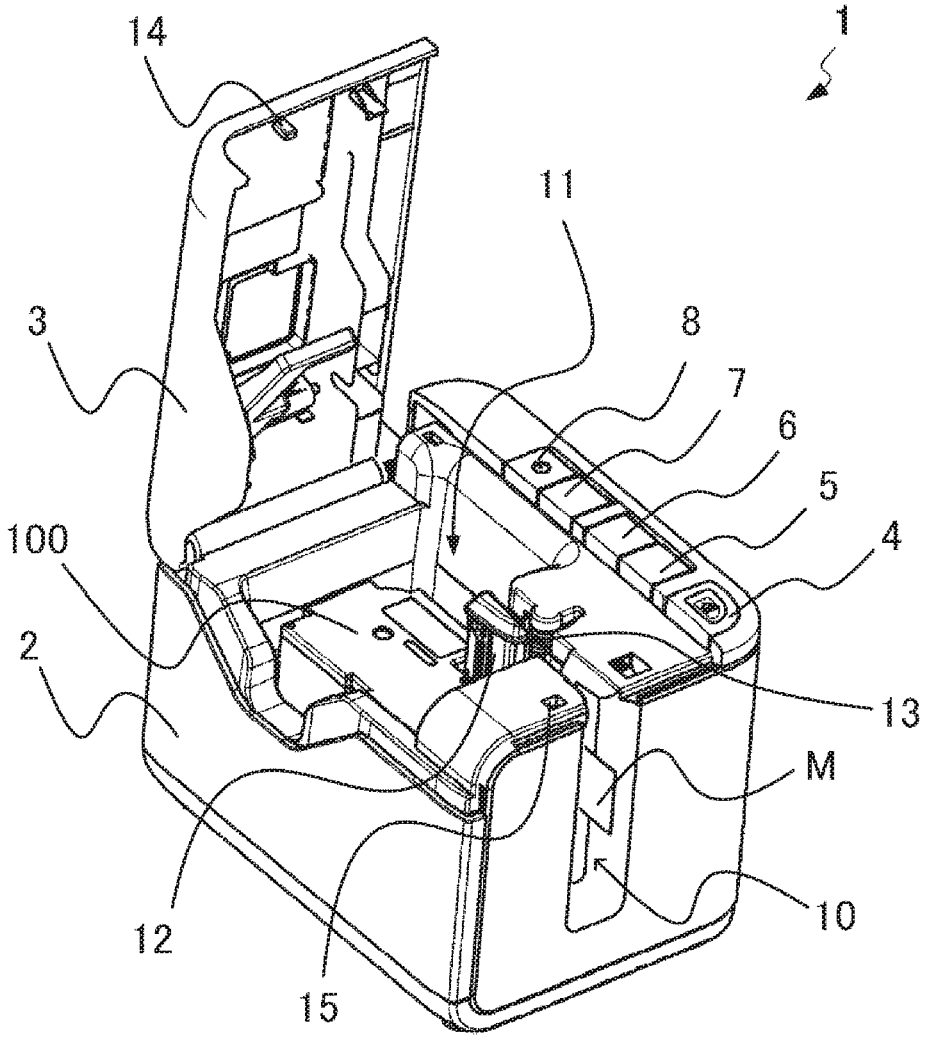
FIG. 2 is a perspective view of the printer 1 when the lid 3 is open.

FIGS. 1 and 2 are perspective views of a printer 1 according to one embodiment. FIG. 1 is a perspective view of a case 2 closed with a lid 3, and FIG. 2 is a perspective view of the lid 3 of the case 2 that is open.

The printer 1 includes a thermal head 12 that is a print head to print on a print medium M. The printer is a label printer, for example, for single-pass printing on a long print medium M. The following describes a thermal-transfer label printer for printing with an ink ribbon as one example, and the printing method is not limited especially. For instance, the printer may be of a thermal printing type for printing with thermal paper.

The print medium M includes a print tape M1 as a first medium having a print surface for printing by the thermal head 12, and a protective tape M2 as a second medium that is stacked on the print tape M1. The print medium M is described later in details.

As shown in FIGS. 1 and 2, the printer 1 includes the lid 3 and a plurality of buttons (button 4, button 5, button 6, button 7, and button 8) at the top face of the cube-like case 2. The button 4 is a button to open and close the lid 3. The buttons 5 to 7 are a cut button, a feed button and a wireless communication button, respectively. The button 8 is a power button. Although not illustrated, the case 2 has a power-cord connection terminal, an external device connection terminal and the like.

The lid 3 is openable/closable relative to the case 2. When a user presses the button 4, the lid 3 is opened, so that a tape cassette 100 housed in a cassette container 11 is exposed as shown in FIG. 2. The lid 3 has a window 9, which allows the user to check visually whether the cassette container 11 houses the tape cassette 100 or not when the lid 3 is closed.

The printer 1 includes a lid sensor 15 to detect the opening/closing of the lid 3. More specifically, when the lid 3 is closed, the lid sensor 15 detects a protrusion 14 at the lid 3. Thereby, the printer 1 can detect the closing of the lid. When the lid 3 is open, the lid sensor 15 does not detect the protrusion 14. Thereby, the printer 1 can detect the opening of the lid.

The case 2 has an ejection port 10 at one lateral face. After printing on the print medium M, the printer 1 discharges the print medium to the outside through the ejection port 10. The ejection port 10 discharges the print medium M so that the print surface of the print medium M is orthogonal to the plane on which the printer 1 is placed.

Figure 3:
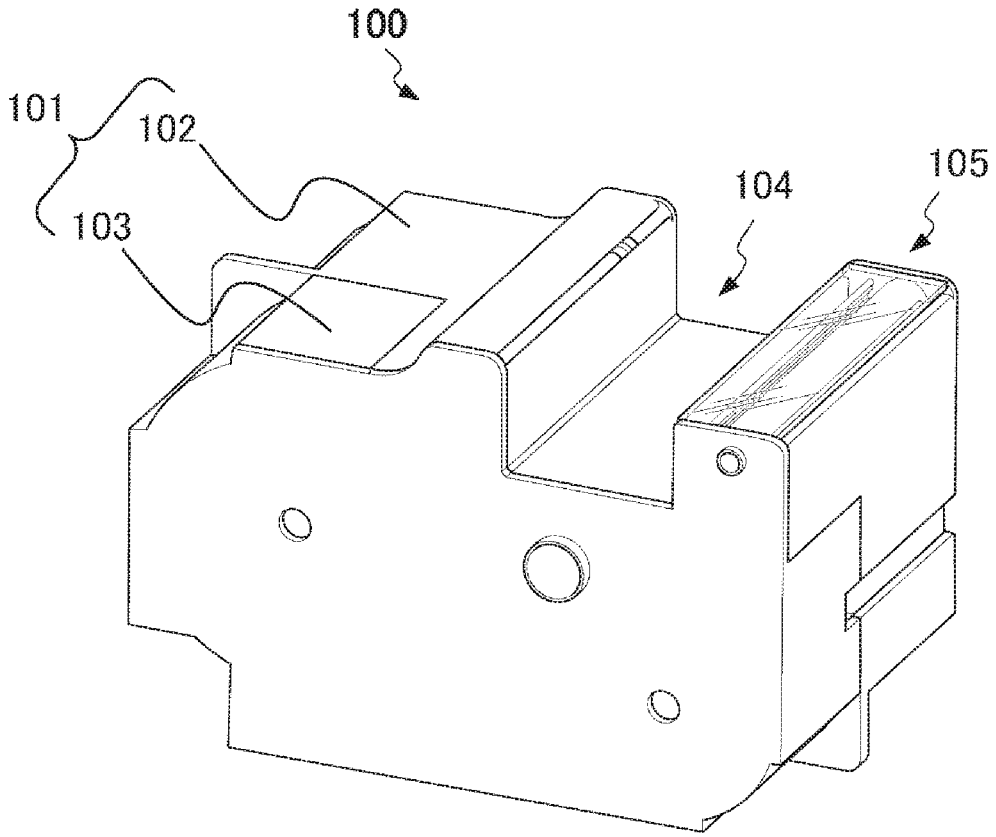
FIG. 3 is a perspective view of a tape cassette 100.
Figure 4:
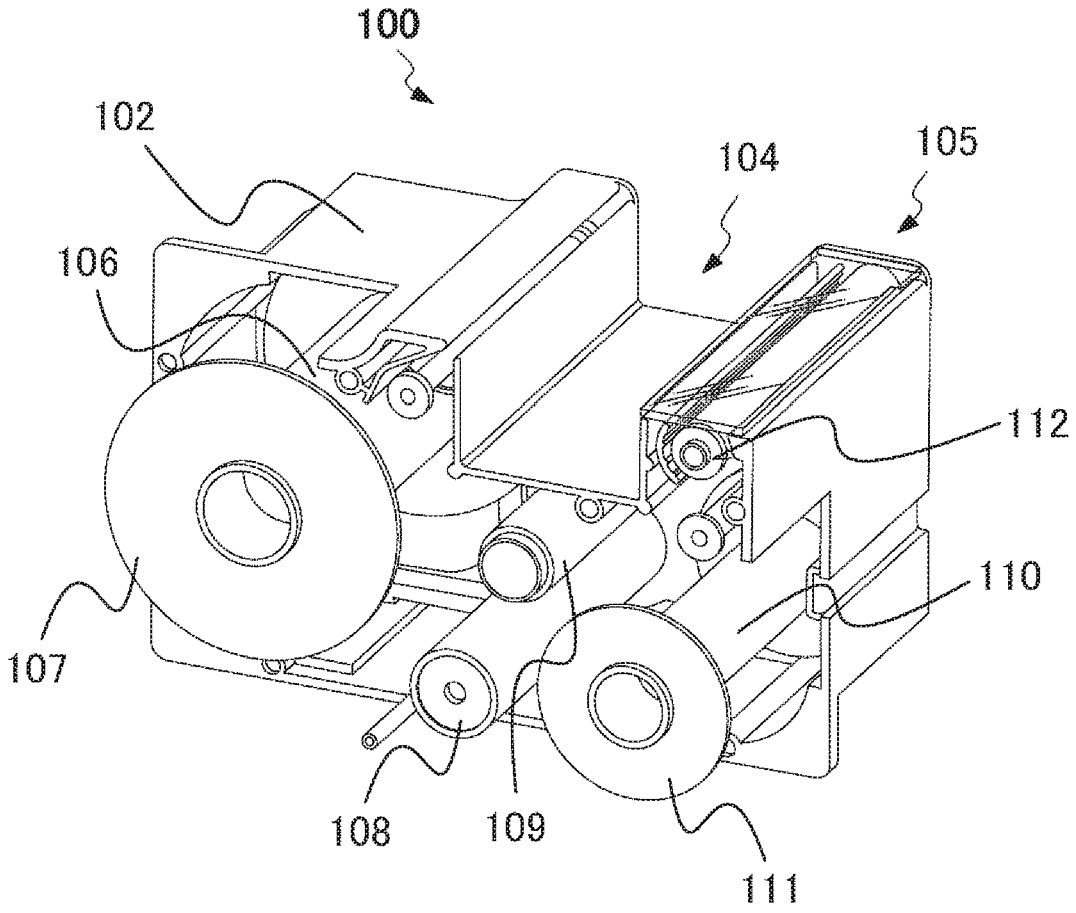
FIG. 4 is a perspective view of the tape cassette 100 after removing the upper case 103.

FIG. 3 is a perspective view of the tape cassette 100. FIG. 4 is a perspective view of the tape cassette 100 after removing the upper case 103. FIG. 4 shows the tape cassette 100, from which a medium (print tape M1, protective tape M2 and ink ribbon R) to be housed in the tape cassette is removed.

The tape cassette 100 is replaceably housed in the cassette container 11 of the printer 1. The tape cassette 100 has a cassette case 101 having a thermal head insertion part 104. The thermal head insertion part 104 is a recess at the position corresponding to the thermal head 12 when the tape cassette 100 is housed in the cassette container 11.

The cassette case 101 has a lower case 102 and the upper case 103, and includes a temporary bonding unit 105. The lower case 102 includes a print tape roller 106, an ink ribbon feed roller 108, an ink ribbon winding roller 109, a protective tape roller 110, and a temporary bonding roller 112.

The print tape roller 106 includes a print tape M1 wound therearound. The print tape roller 106 is a driven roller that rotates in the forward direction that is a direction to extract the print tape M1 from the print tape roller 106. The print tape roller is a driving roller as well that rotates in the reverse direction that is a direction to wind the print tape M1 around the print tape roller 106. The print tape roller 106 includes a flange 107 to prevent the print tape M1 from displacing in the axial direction when winding the print tape M1.

The ink ribbon feed roller 108 is a driven roller to feed the ink ribbon R. The ink ribbon winding roller 109 is a driving roller to wind the ink ribbon R from the ink ribbon feed roller 108. To the ink ribbon winding roller 109, one end of the ink ribbon R is fixed.

The protective tape roller 110 is a roller to wind the protective tape M2 therearound. The protective tape roller 110 is a driven roller that rotates in the forward direction that is a direction to extract the protective tape M2 from the protective tape roller 110. The print tape roller is a driving roller as well that rotates in the reverse direction that is a direction to wind the protective tape M2 around the protective tape roller 110. The protective tape roller 110 includes a flange 111 to prevent the protective tape M2 from displacing in the axial direction when winding the protective tape M2.

The temporary bonding roller 112 is a driving roller that rotates in the forward direction that is a direction to extract the protective tape M2 from the protective tape roller 110. The temporary bonding roller extracts the protective tape M2 from the protective tape roller 110 for feeding. The temporary bonding roller 112 is included in the temporary bonding unit 105 to temporary bond the print tape M1 and the protective tape M2. Temporary bonding means that the print tape M1 and the protective tape M2 are bonded mutually so that they can be separated after temporary bonding. More specifically, after attaching the protective tape M2 to the print tape M1, the print tape roller 106 and the protective tape roller 110 rotate in the reverse direction so as to bond the print tape M1 and the protective tape M2 so that they can be separated after bonding.

Figure 5:
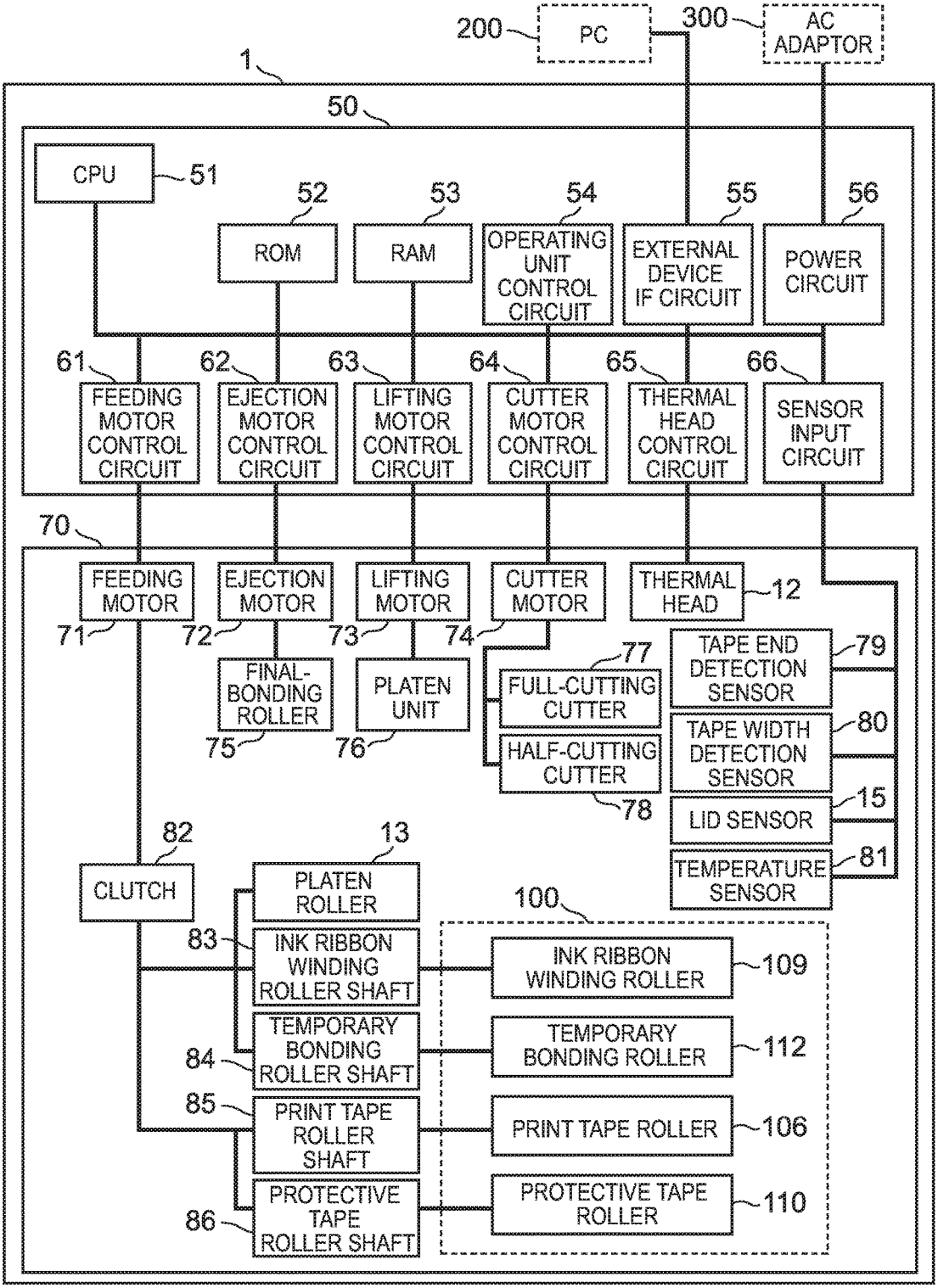
FIG. 5 is a block diagram of the hardware configuration of the printer 1.
Figure 6:
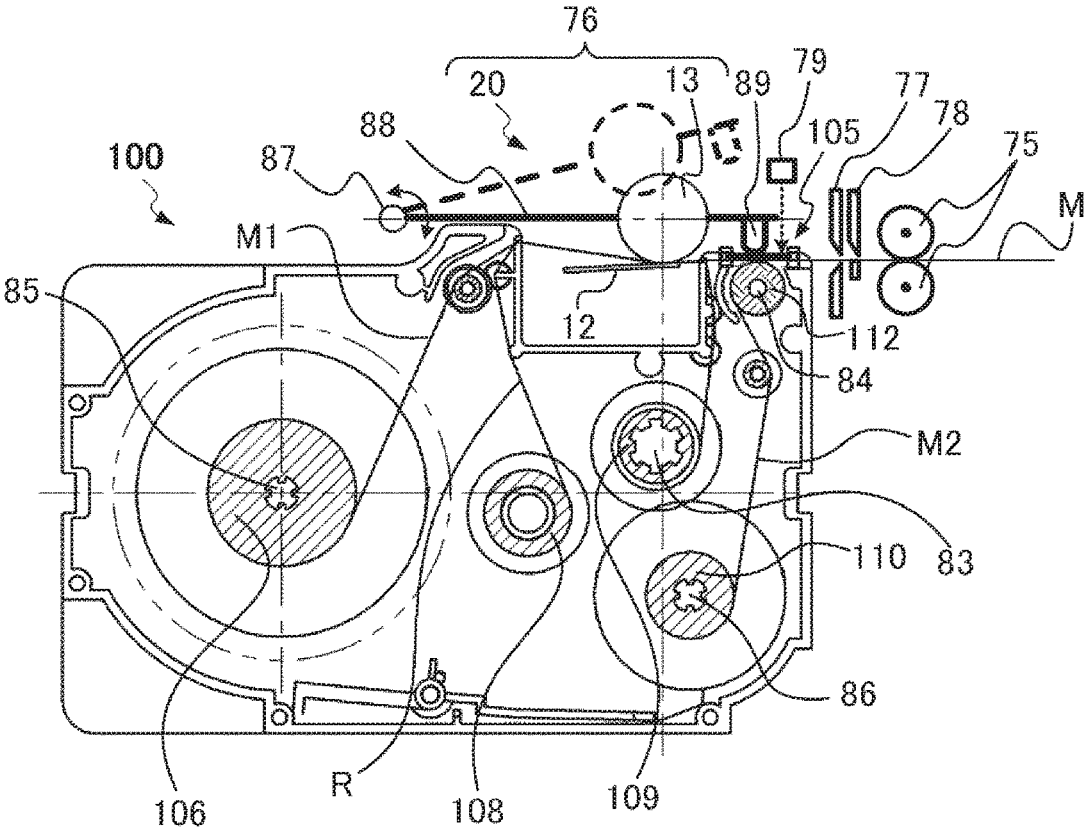
FIG. 6 shows the configuration of the printer 1 having the tape cassette 100 housed in the printer.
Figure 7:
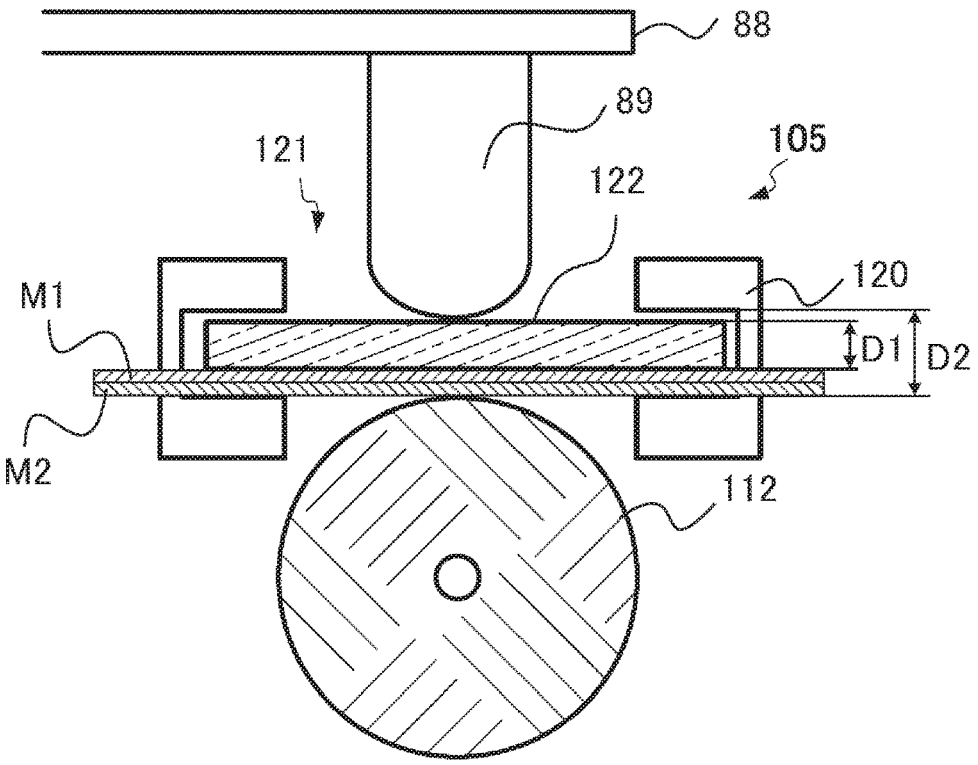
FIG. 7 shows the configuration of the temporary bonding unit 105 of the tape cassette 100.

FIG. 5 is a block diagram of the hardware configuration of the printer 1. FIG. 6 shows the configuration of the printer 1 having the tape cassette 100 housed in the printer. FIG. 7 shows the configuration of the temporary bonding unit 105 of the tape cassette 100.

As shown in FIG. 5, the printer 1 includes a controller 50 and a driver 70. The controller 50 is a computer that controls the driver 70. The controller 50 includes a CPU 51, a ROM 52, a RAM 53, an operating unit control circuit 54, an external device IF circuit 55, a power circuit 56, a feeding motor control circuit 61, an ejection motor control circuit 62, a lifting motor control circuit 63, a cutter motor control circuit 64, a thermal head control circuit 65, and a sensor input circuit 66.

The CPU 51 expands a program stored in the ROM 52 on the RAM 53 for execution to control the operation of various parts of the printer 1. The ROM 52 stores a system program, a print program for printing on the print medium M, and various types of data (e.g., fonts, and an energization table) required to execute the print program. The RAM 53 functions as a print data memory to store pattern data for printing.

The operating unit control circuit 54 receives a signal in accordance with button operation by the user and outputs it to the CPU 51 or the like. The external device IF circuit 55 exchanges data with an external device, such as a PC 200, via wire or wirelessly. The power circuit 56 generates output voltage based on DC voltage from an AC adaptor 300, and supplies electricity to various parts of the printer 1.

The feeding motor control circuit 61 controls the operation of a feeding motor 71 that is included in the driver 70. The feeding motor 71 is a stepping motor, for example, and is connected to a platen roller 13, an ink ribbon winding roller shaft 83, a temporary bonding roller shaft 84, a print tape roller shaft 85, and a protective tape roller shaft 86 via a clutch 82. The clutch 82 switches the rollers to transmit the power from the feeding motor 71.

As shown in FIG. 6, the platen roller 13 is a feed roller to feed the print medium M that is discharged from the tape cassette 100. More specifically the platen roller 13 is a driving roller in the printer 1 to feed the print tape M1 having a print surface while pressing the print surface against the thermal head 12 having the ink ribbon R therebetween. As shown in FIG. 6, the ink ribbon winding roller shaft 83, the temporary bonding roller shaft 84, the print tape roller shaft 85, and the protective tape roller shaft 86 are drive shafts disposed in the cassette container 11, which engage with the ink ribbon winding roller 109, the temporary bonding roller 112, the print tape roller 106, and the protective tape roller 110, respectively, in the tape cassette 100.

The feeding motor 71 rotates and generates the power under the control of the feeding motor control circuit 61 during the print processing described later, and this power is transmitted to the platen roller 13, the ink ribbon winding roller shaft 83, and the temporary bonding roller shaft 84 via the clutch 82. Thereby the platen roller 13 feeds the print tape M1 and the ink ribbon R, so that the mutually overlapped print tape M1 and ink ribbon R pass through between the thermal head 12 and the platen roller 13. Thereafter the ink ribbon winding roller 109 winds the ink ribbon R, and the print tape M1 reaches the temporary bonding roller 112. The temporary bonding roller 112 feeds the print tape M1 that is overlapped with the protective tape M2 extracted from the protective tape roller 110.

Meanwhile, the feeding motor 71 rotates and generates the power under the control of the feeding motor control circuit 61 during the print preparation processing described later, and this power is transmitted to the print tape roller shaft 85 and the protective tape roller shaft 86 via the clutch 82. Thereby the print tape roller 106 feeds the print tape M1 in the reverse direction, and the protective tape roller 110 feeds the protective tape M2 in the reverse direction.

The ejection motor control circuit 62 controls the operation of the ejection motor 72 included in the driver 70. The ejection motor 72 is a stepping motor, for example, and is connected to a final bonding roller 75. As shown in FIG. 6, the final bonding roller 75 includes a pair of rollers disposed in the printer 1, and at least one of the rollers is a driving roller. The final bonding roller 75 feeds the print tape M1 and the protective tape M2 that make up the print medium M (labels) and are in the temporary-bonded state discharged from the tape cassette 100 while final-bonding these tapes, and discharges this through the ejection port 10. Final bonding means that the print tape M1 and the protective tape M2 are bonded so that they cannot be separated or can hardly be separated after final bonding.

The lifting motor control circuit 63 controls the operation of the lifting motor 73 included in the driver 70. The lifting motor 73 is a stepping motor, for example, and is connected to a platen unit 76. As shown in FIG. 6, the platen unit 76 includes the platen roller 13 and a lifting unit 20 to move the platen roller 13 up and down. The lifting unit 20 includes a rotary shaft 87, a lifting plate 88 that extends from the rotary shaft 87, and a protrusion 89 at the lifting plate 88.

Rotation of the lifting motor 73 moves the platen roller 13 up and down. More specifically the platen roller 13 moves between the state indicated with the solid line (hereinafter called a first state) in FIG. 6 and the stated indicated with the broken line (hereinafter called a second state) in FIG. 6.

The platen roller 13 has the first state during the print processing described later, and in this state, the platen roller 13 presses the print tape M1 and the ink ribbon R against the thermal head 12. In this state, i.e., when the platen roller 13 is brought closer to the thermal head 12, the lifting unit 20 presses the temporary bonding unit 105 with the protrusion 89. The temporary bonding unit 105 receiving such a pressing force from the lifting unit 20 temporarily bonds the print tape M1 printed by the thermal head 12 and the protective tape M2 extracted from the protective tape roller 110 mutually. Such a temporary-bonding operation is described below in details.

As shown in FIG. 7, the temporary bonding unit 105 includes the temporary bonding roller 112, a container 120 and a plate-like member 122. The temporary bonding roller 112 is opposed to the plate-like member 122 via the print tape M1 and the protective tape M2, and feeds the protective tape M2. The container 120 is disposed on the feeding path of the print medium M, and contains the plate-like member 122 that is made of a transparent material. The plate-like member 122 may be made of a transmissive material. Note here that transmissive refers to the property of transmitting light. Such a property of the member to transmit light allows the user to see the object through the member. The container 120 has an opening 121 that allows the user to see the plate-like member 122 housed in the container 120 from the outside of the tape cassette 100. This opening 121 defines a through hole of the container 120 so as to penetrate through the container 120 in the direction (hereinafter simply called an intersecting direction) intersecting with the print surface of the print medium M (print tape M1) that is fed along the feeding path. The plate-like member 122 is a pressing member that is opposed to the temporary bonding roller 112 in the container 120 so as to be movable in the intersecting direction. More specifically the plate-like member 122 has thickness D1 that is smaller than height D2 of the inner space of the container 120. This allows the plate-like member 122 housed in the container 120 to be movable in the intersecting direction by a difference between thickness D1 and height D2 in the inner space of the container 120.

In the first state, as shown in FIG. 7, the protrusion 89 on the lifting plate 88 presses the plate-like member 122 in the container 120 through the opening 121. This presses the print medium M toward the temporary bonding roller 112 during the passage of the print medium between the plate-like member 122 and the temporary bonding roller 112. As a result, the print tape M1 and the protective tape M2 are mutually temporary-bonded. That is, when a pressing force is externally applied to temporary-bond the print tape M1 and the protective tape M2 mutually, the plate-like member 122 is disposed at the position to receive such a pressing force. More specifically, the plate-like member 122 is disposed above the print tape M1 and the protective tape M2 at the position where the print tape M1 and the protective tape M2 are overlapped. When a pressing force is externally applied, the plate-like member receives such a pressing force to temporary-bond the print surface F11 of the base of the print tape M1 and the base of the protective tape M2 mutually.

The platen roller 13 has the second state during the print preparation processing described later, and in this state, the platen roller 13 is away from the thermal head 12. In this state, the lifting unit 20 does not press the temporary bonding unit 105, so that the plate-like member 122 is just on the print tape M1 under its own weight.

The cutter motor control circuit 64 controls the operation of the cutter motor 74 included in the driver 70. The cutter motor 74 is a stepping motor, for example, and is connected to a full-cutting cutter 77 and a half-cutting cutter 78. As shown in FIG. 6, the full-cutting cutter 77 and the half-cutting cutter 78 are disposed on the feeding path between the temporary bonding roller 112 and the final bonding roller 75. The full-cutting cutter 77 and the half-cutting cutter 78 operate receiving the power from the cutter motor 74, and full-cuts and half-cuts the print medium M, respectively. Full-cutting refers to the operation of cutting the base of the print medium M as well as the separator along the width direction. Half-cutting refers to the operation of cutting the base part of the print medium M along the width direction, but not cutting the separator.

The thermal head control circuit 65 is connected to the thermal head 12. The thermal head 12 has a plurality of heater elements that are aligned along the main scanning direction (the direction orthogonal to the feed direction). The thermal head control circuit 65 controls heat generation of the heater elements at the thermal head 12, whereby printing is performed on the print surface of the print tape M1 by one print line at one time.

The sensor input circuit 66 is connected to a tape end detection sensor 79, a tape width detection sensor 80, the lid sensor 15, and a temperature sensor 81. The sensor input circuit 66 receives the result of detection by these sensors. As described above, the lid sensor 15 detects the opening/closing of the lid 3.

The tape end detection sensor 79 detects the end of the print medium M on the feeding path between the temporary bonding roller 112 and the final bonding roller 75. The tape end detection sensor 79 may be an optical sensor that detects the end of the print medium M based on reflected light from the print medium M when the print medium M is irradiated with the light, for example. In the example of FIG. 6, the tape end detection sensor 79 is configured to irradiate the print medium M with light via the transparent plate-like member 122 so as to detect the end of the print medium M via the plate-like member 122.

The tape width detection sensor 80 is disposed at the cassette container 11, and detects the width of the print medium M. The tape width detection sensor 80 may detect the width of the print medium M based on the three-dimensional shape of the tape cassette 100, or may detect the width of the print medium M based on an identification mark (e.g., a barcode) attached on the tape cassette 100.

The temperature sensor 81 detects temperature of the thermal head 12. The temperature sensor 81 may be a thermistor embedded in the thermal head 12, for example.

Figure 8:
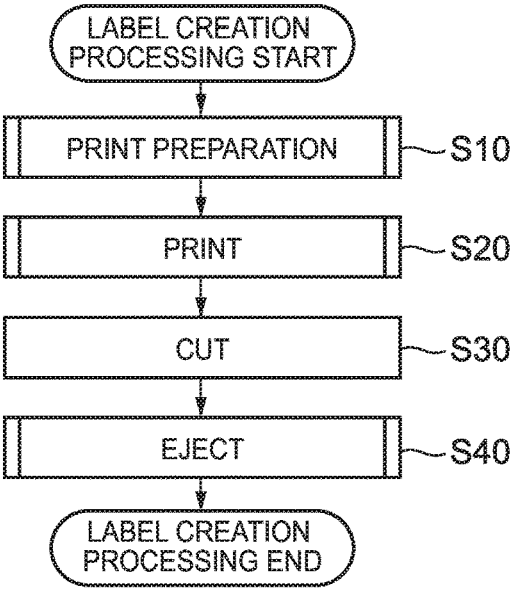
FIG. 8 is a flowchart of the label creation processing by the printer 1.
Figure 9:
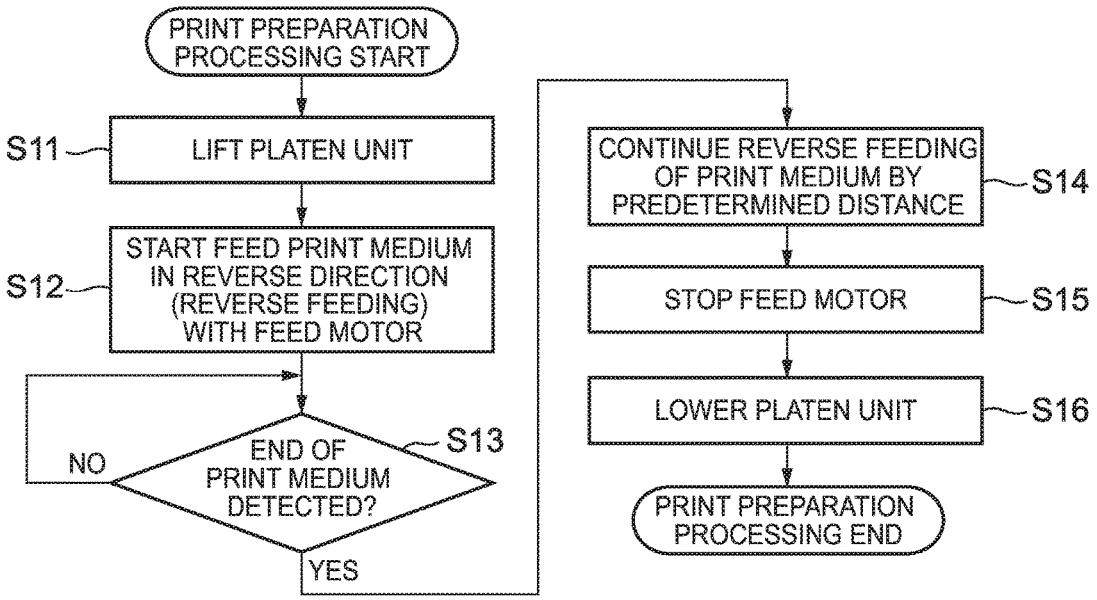
FIG. 9 is a flowchart of the print preparation processing by the printer 1.
Figure 10:
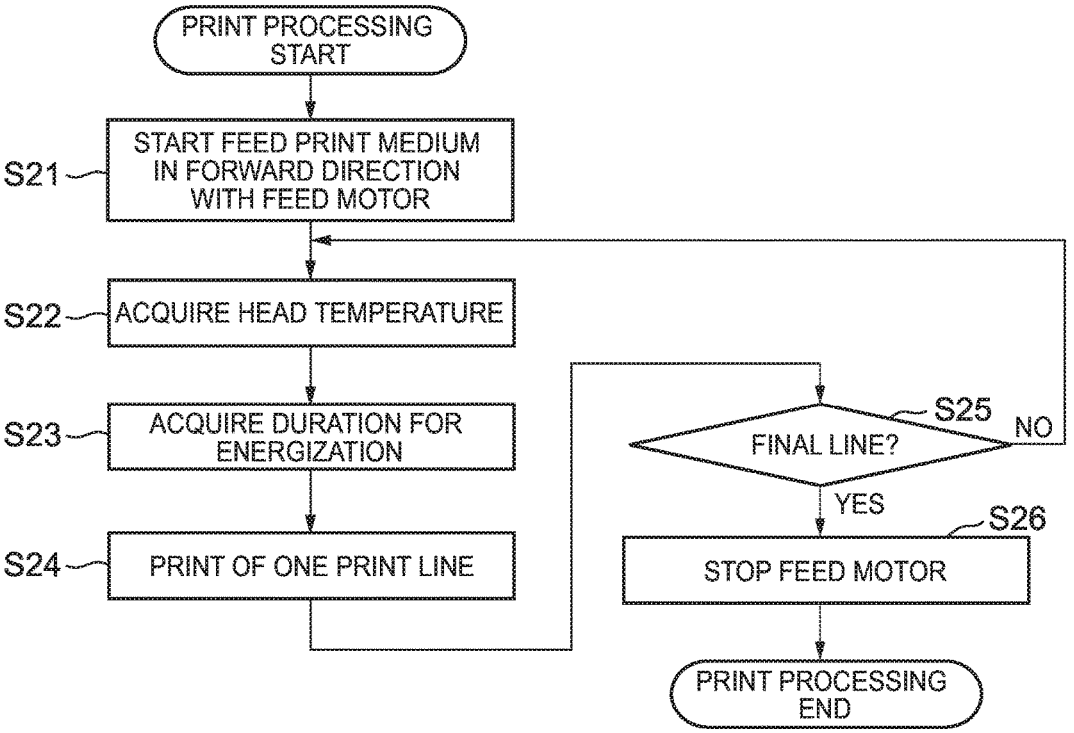
FIG. 10 is a flowchart of the print processing by the printer 1.
Figure 11:
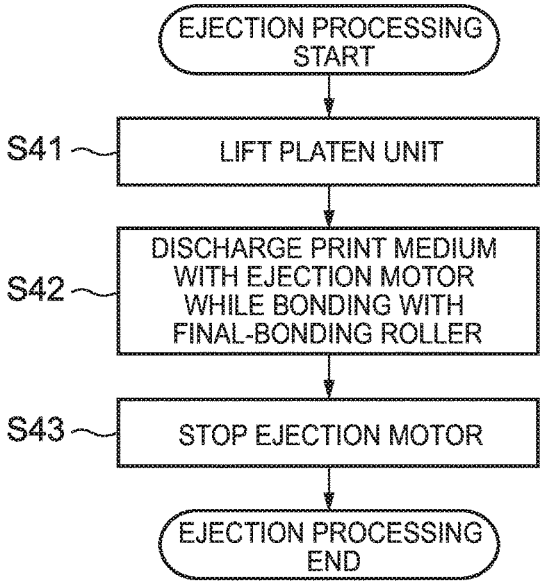
FIG. 11 is a flowchart of the ejection processing by the printer 1.

FIG. 8 is a flowchart of the label creation processing by the printer 1. FIG. 9 is a flowchart of the print preparation processing by the printer 1. FIG. 10 is a flowchart of the print processing by the printer 1. FIG. 11 is a flowchart of the ejection processing by the printer 1. Referring to FIGS. 8 to 11, the following specifically describes the label creation processing by the printer 1.

When the user presses the button 8 to turn the printer on, the printer 1 starts the label creation processing shown in FIG. 8. Firstly, the printer performs the print preparation processing (Step S10).

When the print preparation processing starts, as shown in FIG. 9, the printer 1 lifts the platen unit 76 (Step S11) so that the platen roller 13 is in the second state. In this state, the lifting unit 20 does not press the temporary bonding unit 105.

Next, the printer 1 starts feeding of the print medium M in the reverse direction with the feeding motor 71 (Step S12). At this step, the feeding motor control circuit 61 controls the feeding motor 71, whereby the rotating force of the feeding motor 71 is transmitted to the print tape roller shaft 85 and the protective tape roller shaft 86 via the clutch 82. Then the print tape roller 106 and the protective tape roller 110 start to rotate in the reverse direction. This starts to feed the print medium M in the reverse direction. Then the protective tape M2 temporarily bonded with the print tape M1 is separated, the print tape M1 is wound about the print tape roller 106, and the protective tape M2 is wound about the protective tape roller 110.

This reverse feeding is performed to reduce a wasted empty space at the end of the print medium M as small as possible. When the label creation processing ends, the end of the print medium M is positioned at the full-cutting cutter 77. If label creation starts again without reverse feeding, a wasted empty space will be generated at the end of the print medium M, which corresponds to the distance between the full-cutting cutter 77 and the thermal head 12. In the printer 1, the print medium M is in the temporary bonded state upstream of the full-cutting cutter 77 in the feed direction. Therefore, the print medium M can be fed in the reverse direction while separating the print tape M1 from the protective tape M2. Such reverse feeding of the print medium M prior to the starting of the print processing can reduce a wasted empty space at the end of the print medium M.

After starting the reverse feeding, the printer 1 determines whether the end of the print medium M is detected or not (Step S13). At this step, the printer 1 repeats the determination based on the output from the tape end detection sensor 79 to detect the end of the print medium M.

When the end of the print medium M is detected, the printer 1 continues the reverse feeding of the print medium M by a predetermined distance (Step S14), and then stops the feeding motor 71 (Step S15). When the feeding motor 71 is a stepping motor, whether the reverse feeding by a predetermined distance is performed or not may be determined by counting the number of steps. Alternatively this may be determined based on the time measured with a timer. This allows the end of the print medium M to move to a predetermined position, and as a result, a wasted empty space at the end of the print medium M can be reduced.

After stopping the feeding motor 71, the printer 1 lowers the platen unit 76 until the platen roller 13 is in the first state (Step S16), and ends the print preparation processing. In this state, the lifting unit 20 presses the temporary bonding unit 105.

After the print preparation processing ends, when the printer 1 receives print data from the PC 200, the printer performs print processing (Step S20).

When the print processing starts, as shown in FIG. 10, the printer 1 starts to feed the print medium M in the forward direction with the feeding motor 71 (Step S21). At this step, the feeding motor control circuit 61 controls the feeding motor 71, whereby the rotating force of the feeding motor 71 is transmitted to the platen roller 13, the ink ribbon winding roller shaft 83, and the temporary bonding roller shaft 84 via the clutch 82. Then the platen roller 13, the ink ribbon winding roller 109, and the temporary bonding roller 112 start to rotate forward. This starts to feed the print medium M forward. When the print medium passes through the temporary bonding unit 105, the print tape M1 and the protective tape M2 are mutually temporary-bonded.

When the feeding forward starts, the printer 1 acquires the head temperature (Step S22), and acquires the duration for energization corresponding to the head temperature (Step S23). Then the printer performs printing of one print line (Step S24). In this case, the printer 1 acquires the temperature of the thermal head 12 measured with the temperature sensor 81, and refers to the energization table stored in the ROM 52 to acquire the duration for energization corresponding to the temperature of the thermal head 12. After that, the printer 1 reads print data of one line (hereinafter called print line data) from the RAM 53, and outputs a control signal corresponding to the energization duration acquired at Step S23 and the print line data to the thermal head 12 via the thermal head control circuit 65. Thereby the heater elements at the thermal head 12 generate heat, and printing of one print line is performed on the print surface of the print tape M1.

After that, the printer 1 determines whether printing until the final line ends or not (Step S25). When printing until the final line does not end, the printer repeats the processing from Step S22 to Step S25 until printing of the final line ends. When printing of the final line ends, the printer 1 waits for the feeding of the print medium M to the cut position, and stops the feeding motor 71 (Step S26). Then, the printer ends the print processing.

When the print processing ends, the printer 1 performs cut processing (Step S30). At this step, the printer 1 drives the cutter motor 74 to cut the print medium M with the full-cutting cutter 77 to prepare labels. Labels are obtained by cutting the print medium M.

When the cut processing ends, the printer 1 performs ejection processing (Step S40). When the ejection processing starts, as shown in FIG. 11, the printer 1 firstly lifts the platen unit 76 (Step S41) so that the platen roller 13 is in the second state.

Next, the printer 1 discharges the print medium M (labels) with the ejection motor 72 while performing final bonding with the final bonding roller 75 (Step S42). At this step, the ejection motor control circuit 62 controls the ejection motor 72, whereby the final bonding roller 75 rotates. Thereby the print medium M (label) is final-bonded with the final bonding roller 75, and then is discharged from the ejection port 10.

Finally the printer 1 stops the ejection motor 72 (Step S43) to end the ejection processing and the label creation processing.

As stated above, the printer 1 is configured to discharge the print medium M in the temporary-bonded state from the tape cassette 100, cut the print medium with the full-cutting cutter 77, and final-bond the print medium with the final bonding roller 75. That is, the print medium M is in a removable temporarily bonded state upstream of the full-cutting cutter 77 in the feed direction. Therefore, the print medium M including the print tape M1 bonded with the protective tape M2 mutually can be fed in the reverse direction prior to the starting of print, and this can reduce a wasted space at the end of the print medium M.

Figure 12:
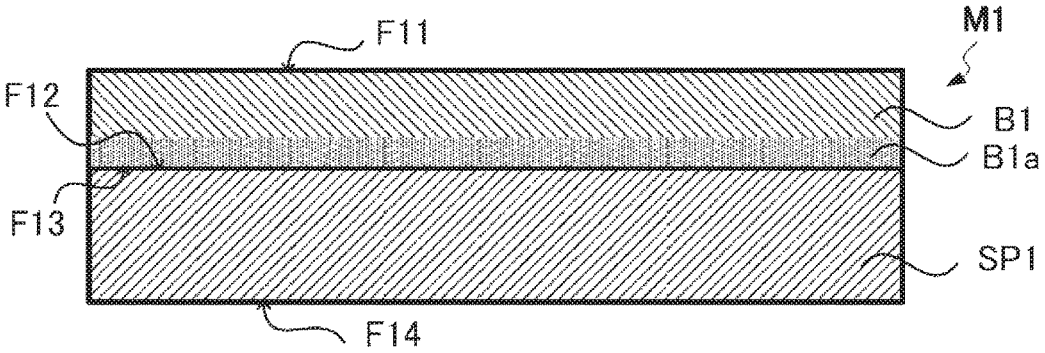
FIG. 12 shows the structure of the print tape M1.
Figure 13:
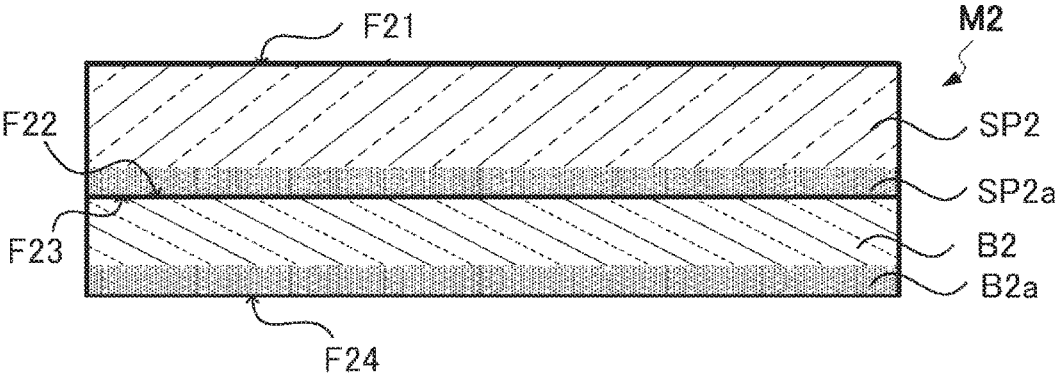
FIG. 13 shows the structure of the protective tape M2.

FIG. 12 shows the structure of the print tape M1. FIG. 13 shows the structure of the protective tape M2. Referring next to FIGS. 12 and 13, the following describes the structure of the tapes included in the tape cassette 100 in details.

The print tape M1 is a first medium wound around the print tape roller 106. As shown in FIG. 12, the print tape includes: the base B1 as a first base having the print surface F11, and the separator SP1 as a first separator that is removably attached to the base B1. More specifically the base B1 has first adhesive applied on the opposite side of the print surface F11, and the separator SP1 is removably attached to the surface F12 of the base B1 on the opposite of the print surface F11 via the first adhesive. The print tape M1 is wound as a roll around the print tape roller 106 so as to direct the separator SP1 inward.

The base B1 is made of a material that is softer than the separator SP1. The separator SP1 is made of a material that is harder than the base B1. The base B1 is desirably made of a stretch material. The base B1 is a tape made of urethane resin, for example, and has a thickness of about 5 to 50 μm. The separator SP1 is a tape made of PET resin or paper (craft paper, glassine paper, high-quality paper or the like), for example. For example, Young's modulus, which defines the relationship between stress and strain, may be used as the values indicating hardness and the property of hardly stretching of the materials. The separator SP1 made of PET resin has Young's modulus of 1 GPa or more, e.g., about 2 to 5 GPa. The separator SP1 made of paper has Young's modulus of 1 GPa or more, e.g., about 1 to 2 GPa. In any case, the separator is relatively hard and hardly stretches, and so has enough hardness and property of hardly stretching that are required to feeding in the printer 1 or carrying without large deformation. Meanwhile, the base B1 as the tape made of urethane resin has Young's modulus of less than 1 GPa, e.g., about 50 to 700 MPa, and is softer and stretches more than the separator SP1. The base B1 made of urethane resin has the maximum stretching ratio of 100% or more, e.g., about 100 to 1000%. On the contrary, the separator SP1 made of PET resin or paper hardly stretches, and has the maximum stretching ratio less than 100%, which is substantially 0%. With this structure, the base B1 can be attached so that it can come in close contact with the uneven attachment surface, such as human skin or fabric, as described later and has a property of not easily separating from the attachment surface because, when human skin, fabric or the like moves to change the shape, it can follow the movement. This base B1 alone, however, tends to bend or wrinkle, and so it is difficult to feed this base alone in the printer 1 or to carry such a base without bending greatly. When the separator SP1 is attached to the base B1, since the separator SP1 has necessary and sufficient hardness as stated above, such a base can be fed in the printer 1 and can be carried without greatly bending. The base B1 and the separator SP1 may be made of transparent materials or opaque materials. They may be colored or colorless. They may have patterns preprinted or not preprinted. Particularly the base B1 having patterns preprinted on the print surface F11 may be used, and such a label can be highly expressive.

The base B1 has a first adhesive layer B1*a* on the surface on the opposite side of the print surface F11 and in contact with the separator SP1, and the first adhesive layer is prepared by applying first adhesive there. The first adhesive layer B1*a* has an adhesive surface F12 on the side in contact with the separator SP1. The adhesive surface is a first adhesive surface. The separator SP1 has a surface F13 in contact with the adhesive surface F12 and a surface F14 on the opposite side of the surface F13.

The protective tape M2 is a second medium wound around the protective tape roller 110. As shown in FIG. 13, the protective tape includes: the base B2 as a transparent second base and the separator SP2 as a transparent second separator that is removably attached to the base B2. The base B2 is made of a material that is softer than the separator SP2. The separator SP2 is made of a material that is harder than the base B2. The base B2 is desirably made of a stretch material. The base B2 is a tape made of transparent urethane resin, for example, and has a thickness of about 5 to 50 μm. The separator SP2 is a tape made of transparent PET resin, for example. The protective tape M2 is wound as a roll around the protective tape roller 110 so as to direct the base B2 inward. Although it is difficult to feed the base B2 as the tape made of urethane resin alone similarly to the base B1 as stated above, when the separator SP2 is attached to the base B2, such a base can be fed in the printer 1. This is because the separator SP2 has necessary and sufficient hardness as stated above. The base B2 and the separator SP2 may not be clear and colorless, and may have transparency allowing the user to see letters and images printed on the print surface F11 through the base B2 and the separator SP2.

The separator SP2 has a second adhesive layer SP2*a* on the side in contact with the base B2, and the second adhesive layer is prepared by applying second adhesive there. The second adhesive layer SP2*a* has an adhesive surface F22 on the side in contact with the base B2. The adhesive surface is a second adhesive surface. The base B2 has a surface F23 in contact with the adhesive surface F22, and the base B2 has a third adhesive layer B2*a* on the opposite side of the surface F23. The third adhesive layer is prepared by applying third adhesive there. The third adhesive layer B2*a* has an adhesive surface F24 on the outer surface that is a third adhesive surface.

Desirably the second adhesive layer SP2*a* with the second adhesive formed at the separator SP2 has adherence lower than that of the first adhesive layer B1*a* with the first adhesive formed at the base B1 and that of the third adhesive layer B2*a* with the third adhesive formed at the base B2. Particularly the first adhesive of the first adhesive layer B1*a* is desirably for human skin or fabric. The following describes an example in which the first adhesive of the first adhesive layer B1*a* is for human skin or fabric. Note here that labels created by the printer 1 can be attached not only to human skin or fabric but also to an object having an uneven attachment surface so that the labels can be in close contact with such an uneven attachment surface. Especially human skin or fabric does not have a fixed shape or unevenness but changes in shape or unevenness. Labels created by the printer 1, which are a tape made of urethane resin, for example, are relatively soft and easily stretch, and so can change in shape so as to follow such a change in shape of the human skin or the fabric. With this structure, such a label attached to human skin or fabric can follow a change in shape of the skin or fabric due to the movement, and so hardly peels off from there.

FIGS. 14A-14E show the procedure to attach a label created by the printer 1 to fabric, human skin or the like. Referring to FIGS. 14A-14E, the following describes the procedure to attach a label created by the printer 1 in details.

Figure 14A:
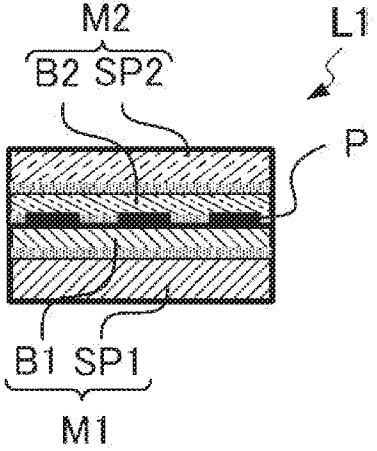
FIGS. 14A-14E show the procedure to attach a label created by the printer 1.

The printer 1 prints on the print surface F11 of the print tape M1 with the thermal head 12. After that, the print tape M1 and the protective tape M2 that are overlapped so that their print surface F11 and adhesive surface F24 are opposed pass through the temporary bonding unit 105, whereby the temporary bonding unit 105 temporary-bonds the base B1 of the print tape M1 and the base B2 of the protective tape M2. After that, the full-cutting cutter 77 cuts the temporary-bonded print medium M to create the print medium M as labels. After that, the final bonding roller 75 final-bonds the base B2 of the protective tape M2 with the base B1 of the print tape M1 mutually that make up the print medium M (label) and discharges a label L1 shown in FIG. 14A from the printer 1. Note here that ink P between the base B1 and the base B2 in FIG. 14A is formed by printing.

Figure 14B:
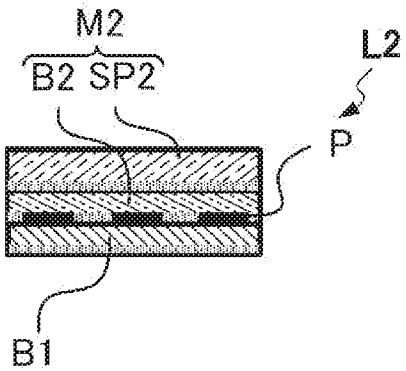
Figure 14C:
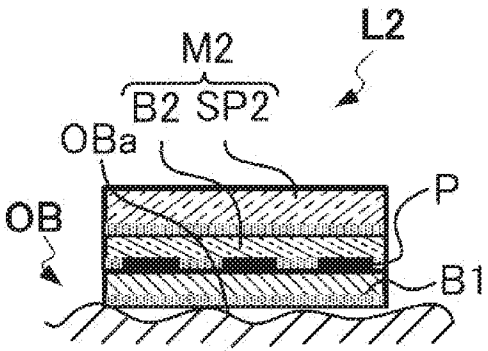

After that, as shown in FIG. 14B, the user peels off the separator SP1 of the print tape M1 from the label L1 to expose the adhesive surface F12. Then as shown in FIG. 14C, the user places the label on the uneven attachment surface OBa of the object OB, such as fabric or human skin (hereinafter simply referred to as fabric or the like) for attachment. At this time, since the base B2 has the separator SP2 attached thereto, the label L2 is in a substantially flat state. This means that the adhesive surface F12 of the base B1 is attached to the projections of the attachment surface OBa. The label L2 having the adhesive surface F12 exposed as shown in FIG. 14B includes the separator SP2 that is harder than the base B1 and the base B2. The label L2 as a whole therefore has sufficient hardness even when the base B1 and the base B2 are soft members. This can prevent large deformation of the label L2 when the user carries the label L2 with the hand, for example, before attachment of the label L2 to the fabric or the like as shown in FIG. 14C. The user therefore can attach the label L2 easily to the fabric or the like at a desired position.

Figure 14D:
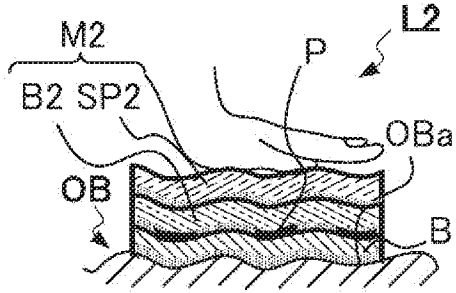

Next, as shown in FIG. 14D, the user presses the label L2 against the object OB, such as the fabric, with the hand on the separator SP2 while rubbing the surface of the separator SP2 so as to bring the label L2 in close contact with the attachment surface OBa, such as the fabric. This stretches the base B1 and the base B2 along the shape of the unevenness of the attachment surface OBa until the adhesive surface F12 of the base B1 including the adhesive for human skin or fabric applied adheres to the fabric or the like for close contact with the uneven attachment surface OBa and for secure attachment.

Figure 14E:
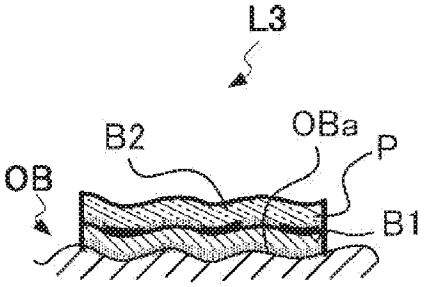

Finally as shown in FIG. 14E, the user peels off the separator SP2 from the label L2, whereby a label L3 including the members (base B1 and base B2) softer than the separators (separator SP1 and separator SP2) can be obtained.

As shown in FIG. 14C to FIG. 14E, the label (label L1, label L2 and label L3 are collectively called label L) created by the printer 1 is attached to the fabric or the like due to the adherence of the adhesive. This means that the user can attach the label L easily to the fabric or the like without a need of ironing or the like.

As shown in FIG. 14E, the final label L3 includes the base B1 and the base B2 that are a relatively soft member, and does not include the separator SP1 and the separator SP2 that are relatively hard members. This allows the label L3 to change in shape so as to follow a change in shape of the fabric or the like. That is, a gap hardly occurs between the label L3 and the fabric or the like, and this can prevent the attached label L3 from peeling off from the fabric or the like. Especially the base B1 and the base B2 made of a stretch material can further prevent the label L3 from peeling off.

The label L2 includes the separator SP2 that is harder than the base B1 and the base B2. Such a separator SP2 allows the label L2 to keep the shape of the label L2 when the user attaches the label to the fabric or the like. Therefore the user does not feel the difficulty during attachment of the label L2, which includes the base B1 and the base B2 made of relatively soft members and would have an instable shape if alone, and can attach easily the label L2 to the fabric or the like at a desired position.

The label L2 includes the protective tape M2 (base B2 and separator SP2) made of a transparent or transmissive material. Therefore the user can see the print pattern (ink P) formed on the print surface F11 of the base B1 through the base B2 and the separator SP2 when the user attaches the label L2 to the fabric or the like. The user therefore can adjust the position of the label L2 easily during attachment.

In this way, the tape cassette 100 storing the print tape M1 and the protective tape M2 can support the creation of labels by the printer 1, and the labels can be easily attached to the fabric or the like.

The final label L3 includes the base B1 having the print surface F11 that is covered with the base B2, which means that the print surface F11 is not exposed to the surface. That is, the base B2 functions as a protective layer of the print surface F11, which can improve the resistance to abrasion and washing durability of the label.

In this way, the tape cassette 100 can support the creation of labels having good resistance to abrasion and washing durability.

A tape cassette typically is designed so that the space to store the print tape M1 is larger than the space to store the protective tape M2 as shown in the tape cassette 100 of FIG. 4. This means that the length of the print tape M1 that can be used for printing is practically limited due to the length of the protective tape M2. In the case of this tape cassette 100, the protective tape M2 having a double-layered structure can be thinner than the print tape M1 also having a double-layered structure. This is because the base B2 of the protective tape M2 may have a thickness that can function as the protective layer of the print surface F11, and so can be thinner than the base B1 having the print surface. Therefore a longer protective tape M2 can be stored in a smaller space.

The tape cassette 100 therefore can make the length of the print tape M1 that can be used for printing substantially longer.

The tape cassette 100 has the temporary bonding unit 105, and discharges the print medium M including the print tape M1 and the protective tape M2 that are temporary bonded. This allows separation of the print tape M1 and the protective tape M2 by reverse feeding before winding, and can reduce a wasted space at the end of the print medium M.

In this way, the tape cassette 100 can omit a user's job to cut a wasted space from the created labels. This also leads to efficient usage of resources. Especially the temporary bonding unit 105 includes the temporary bonding roller 112 and the plate-like member 122 opposed to the temporary bonding roller 112 so as to be movable in the direction intersecting with the print surface F11. This enables temporary-bonding of the print tape M1 and the protective tape M2 with an extremely simple configuration, and so the above-stated advantageous effects can be achieved easily.

The printer 1 housing such a tape cassette 100 can print any letters and graphics on the print surface in accordance with print data. A user therefore can freely create labels having information different from each user, such as the name, printed thereon, and can attach such labels on their clothing, for example.

Since the tape cassette 100 is stored replaceably, the printer 1 can create labels having different widths or colors by replacing the tape cassette 100 with another one storing a tape with a different width or color.

That is the description of the embodiments by way of specific examples for easy understanding of the present invention, and the present invention is not limited to these embodiments. The tape cassette and the printer can be variously modified or changed without departing from the scope of the claims.

The above describes the base B1 of the print tape M1 made of urethane resin, for example, that is relatively soft, and the hardness of the base B1 may not be uniform in the thickness direction. The print surface F11 is for printing, and therefore the base B1 on the side of the print surface F11 preferably has certain hardness for better printing. Meanwhile, the base B1 on the opposite side of the print surface F11 does not have to have such hardness. The base B1 therefore may be different in hardness between the print surface F11 and the opposite side, and the side of the print surface F11 may be harder than the opposite side.

The above describes the example where the tape cassette 100 has the temporary bonding unit 105. The tape cassette 100 may include a bonding unit to mutually bond the base B1 of the print tape M1 and the separator SP2 of the protective tape M2, and the bonding at the bonding unit may be temporary bonding or final bonding.

What is claimed is:

1. A tape cassette to store:

a first medium comprising (i) a first base having a print surface for printing and a first adhesive applied on an opposite side of the print surface, and (ii) a first separator removably attached to the first base via the first adhesive; and a second medium comprising a second base, and a second separator removably attached to the second base, wherein the tape cassette includes a pressing member that is movable in a direction intersecting with a direction of a plane of the print surface, and wherein the pressing member is disposed at a position of, when a pressing force is externally applied to perform mutual bonding of the first medium and the second medium, receiving the pressing force.

2. The tape cassette according to claim 1, wherein:

the second base has a transmissive property allowing a user to see the printing on the print surface through the second base, the second separator has a transmissive property allowing the user to see the printing on the print surface through the second separator, and the bonding bonds the second base of the second medium to the print surface of the first base of the first medium.

3. The tape cassette according to claim 1, wherein the first base is different in hardness in a direction of thickness of the first base, and a side of the print surface has hardness larger than hardness of a side on the opposite of the print surface.

4. The tape cassette according to claim 1, wherein the second separator is made of a material that is harder than the first base and the second base.

5. The tape cassette according to claim 1, wherein the pressing member is disposed above the first medium and the second medium at a position where the first medium and the second medium are overlapped, and is a plate-shaped member that, when the pressing force is externally applied, receives the pressing force to mutually bond the print surface of the first base and the second base.

6. The tape cassette according to claim 5, further comprising:

a bonding roller that is opposed to the plate-like member via the first medium and the second medium, and feeds the second medium.

7. The tape cassette according to claim 1, wherein the first base and the second base are made of a material having a stretch property such that, after the second base is bonded to the print surface of the first base, and the first base is attached to protrusions of an uneven attachment surface of an object via the first adhesive, when a pressing force is applied to the first base and the second base toward the attachment surface, the first base and the second base stretch along the unevenness and come in close contact with the attachment surface.

8. The tape cassette according to claim 1, wherein the first separator is made of a material that is harder than the first base.

9. The tape cassette according to claim 1, wherein:

the first base is a tape made of urethane resin, the second base is a tape made of urethane resin having a transmissive property, the first separator is a tape made of PET resin or paper, and the second separator is a tape made of PET resin having a transmissive property.

10. The tape cassette according to claim 1, wherein:

the second separator includes a second adhesive applied on a side in contact with the second base, the second base includes a third adhesive applied on an opposite side of the side in contact with the second separator, and the second adhesive has adherence lower than adherence of the first adhesive and of the third adhesive.

11. A printer comprising:

a cassette container to house a tape cassette configured to store (i) a first medium comprising a first base having a print surface for printing and an adhesive applied on an opposite side of the print surface, and a first separator removably attached to the first base via the adhesive, and (ii) a second medium comprising a second base and a second separator removably attached to the second base, the tape cassette including a pressing member that is movable in a direction intersecting with a direction of a plane of the print surface, and the pressing member being disposed at a position of, when a pressing force is externally applied to mutually bond the first medium and the second medium, receiving the pressing force;

a feed roller configured to feed the first medium discharged from the tape cassette;

a print head configured to print on the print surface of the first base of the first medium; and a lifting unit configured to move the feed roller up and down, wherein when the feed roller is brought closer to the print head, the lifting unit applies the pressing force to the first medium while feeding the first medium with the feed roller so that the second base is bonded to the print surface of the first base.

* * * * *